US006808460B2

(12) United States Patent
Namiki

(10) Patent No.: US 6,808,460 B2
(45) Date of Patent: Oct. 26, 2004

(54) SWING CONTROL WEIGHT

(76) Inventor: Tosiki Namiki, 120-1 Nozawa, Saku-shi, Nagano (JP), 385-0053

( * ) Notice: Subject to any disclaimer, the term of this patent is extended or adjusted under 35 U.S.C. 154(b) by 0 days.

(21) Appl. No.: 10/658,255

(22) Filed: Sep. 10, 2003

(65) Prior Publication Data

US 2004/0058740 A1 Mar. 25, 2004

(30) Foreign Application Priority Data

Sep. 11, 2002 (JP) ..... 2002-265526

(51) Int. Cl.[7] ..... A63B 69/36
(52) U.S. Cl. ..... 473/256
(58) Field of Search ..... 473/256, 297, 473/300, 519, 457; 482/109; 273/288–291, 153 P, 156; D21/386, 479

(56) References Cited

U.S. PATENT DOCUMENTS 985,253 A * 2/1911 Erickson ..... 273/160
1,696,462 A * 12/1928 Victor ..... 473/297
4,822,052 A * 4/1989 Dimmick et al. ..... 473/285
4,858,925 A * 8/1989 DeStefano, Jr. ..... 473/285
4,957,293 A * 9/1990 Byrd ..... 473/285
5,330,193 A * 7/1994 Ijiri ..... 473/256
5,759,111 A * 6/1998 Clark ..... 473/285
6,095,521 A * 8/2000 Patel ..... 273/156
6,354,958 B1 * 3/2002 Meyer ..... 473/297

* cited by examiner

*Primary Examiner*—Gregory Vidovich
*Assistant Examiner*—Nini F. Legesse
(74) *Attorney, Agent, or Firm*—Bacon & Thomas, PLLC

(57) ABSTRACT

A swing control weight used in a golf club. The swing control weight includes a main body composed of a quarter-disc-shaped member and having a right-angle corner portion formed of a side facing forward of a swing direction of a user and the other side facing the user and projections disposed near the right-angle corner portion of a front main surface of the main body and near the extreme end of the side facing forward of the swing direction, respectively. Alternatively, the projections are disposed near the side facing the user of the front main surface of the main body and to the side facing the user, respectively, and the position of the main surface projection at the rear end of swing thereof is located at approximately the same position as that of the position of the side surface projection at the front end of swing thereof.

7 Claims, 6 Drawing Sheets

SWING CONTROL WEIGHT

BACKGROUND OF THE INVENTION

1. Field of the Invention

The present invention relates to a swing control weight for a club, bat, racket and the like used in various sports.

2. Description of the Related Art

Conventionally, there are commercially available disc-shaped weights as auxiliary devices for supporting a golfer to make a swing suitable for him or her using a golf club. The disc-shaped weight is ordinarily bonded on the rear end surface of the grip of a golf club or embedded into the rear end surface by removing a rubber covering it and used to adjust the balance of the golf club with respect to a head located at the extreme end of the golf club. As a result, the golfer can make a swing suitable for him or her by moving the center of gravity of the golf club toward the rear end surface side thereof.

However, when the weight is formed in the disc shape, it is difficult for the golfer to smoothly move the golf club aiming at a ball because the weigh does not have directionality. Therefore, the golfer cannot obtain a long carry of the ball because he cannot strongly and completely swing the golf club. Moreover, the ball is liable to slice (curve right) or to hook (curve left).

To cope with the above problems, the applicant proposes a swing control weight composed of a quarter-disc-shaped member to provide the weight with directionality in Japanese Patent Application No. 2001-085173.

When the swing control weight arranged as described above is used, the golfer can be conscious of the relation between a swing direction and the positions of the two orthogonal sides of the weight because the golfer can feel the distributed state of weights of the swing control weight based on the shape of the weight while imaging the shape. Thus, since the swing state of the golf club can be automatically corrected by the weight, the golf club is unlikely to be irregularly swung so that the head can hit the ball on a face at right angles, thereby a patting accuracy can be improved. Accordingly, the straight-traveling-stability of the ball is enhanced because the ball is unlikely to break right and left. Further, since both the extreme ends of the two orthogonal sides of the weight are connected to each other through an arc-shaped side, the golf club is unlikely to move irregularly at a final swing position, thereby it is possible to speedily and completely swing the golf club so that the carry of the ball is increased.

However an idea for more enhancing the straight-traveling-stability of a ball and increasing the carry of the ball is always required in golf. Further, making a swing easily is a problem to be solved from the view point of decreasing fatigue and increasing power when the swing is made.

An object of the present invention, which was made in view of the conventional problems, is to provide a swing control weight capable of causing a swing to be made easily, increase the straight-traveling stability of a ball and the like, and increasing the carry thereof.

SUMMARY OF THE INVENTION

To achieve the above object, a swing control weight according to the present invention has a main body composed of a quarter-disc-shaped member. Then, a side of the main body, which forms a right-angle corner portion of the main body, is disposed so as to face forward of a swing direction of a user, and the other side thereof is disposed so as to face the user, and projections are disposed in the vicinity of the right-angle corner portion of a front main surface of the main body and in the vicinity of the extreme end of the side facing forward of the swing direction, respectively.

Another swing control weight of the present invention has a main body also composed of a quarter-disc-shaped member. Then, a side of the main body, which forms a right-angle corner portion of the main body, is disposed so as to face forward of a swing direction of a user, and the other side thereof is disposed so as to face the user, projections are disposed in the vicinity of the side facing the user of a front main surface of the main body and to the side facing the user, respectively, and the swing direction rear end position of the main surface projection is located at approximately the same position as that the swing front direction end position of the side projection.

It is preferable to provide an attachment means disposed to a rear main surface of the main body and projecting from the position of the center of gravity of the main body in a direction perpendicular to the rear main surface.

Further, it is preferable to provide an adhesive layer disposed on the rear main surface of the main body.

DESCRIPTION OF THE PREFERRED EMBODIMENTS

Embodiments of the present invention will be explained below with reference to the accompanying FIGS. 1 to 10.

Figure 1:
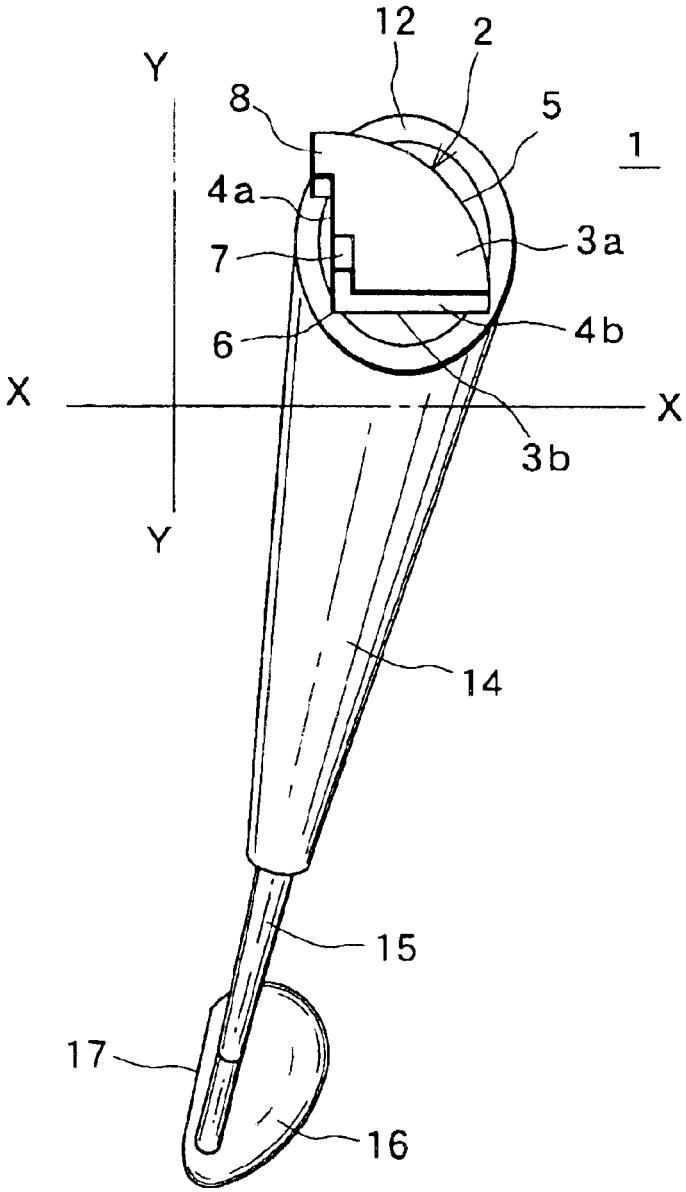
FIG. 1 is a perspective view showing a state in which a swing control weight, to which the present invention is applied, is attached to the rear end surface of the grip of a golf club.
Figure 2:
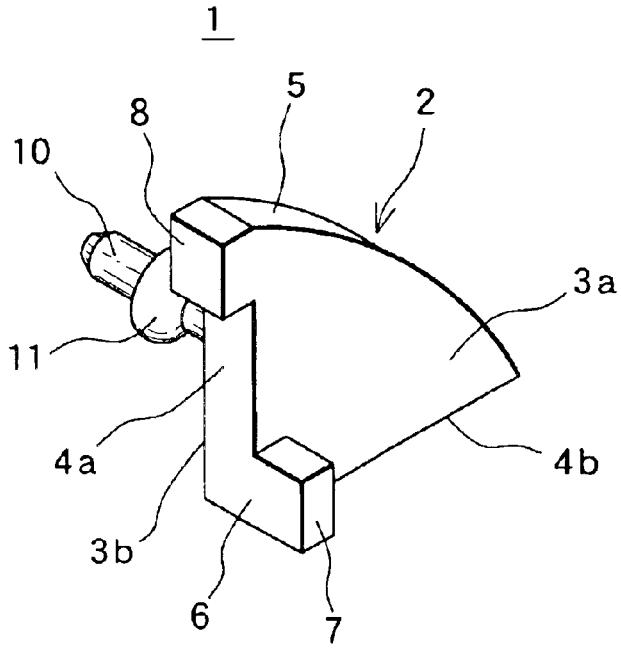
FIG. 2 is a perspective view of the swing control weight.

FIG. 1 is a perspective view showing a state in which a swing control weight 1, to which the present invention is applied, is attached to the rear end surface of the grip of a golf club (wood) 15, and FIG. 2 is a perspective view of the swing control weight. The swing control weight 1 employs a metal member, for example, brass, lead, silver, copper, and the like as a member suitable for it. The weight 1 has a main body 2 composed of a quarter-disc-shaped member, and the disc-shaped member has, for example, a radius of 15 mm, a thickness of 3 mm, and a weight of 10 g. With the above arrangement, the main body 2 naturally has a front main surface 3*a*, a rear main surface 3*b*, two orthogonal sides 4*a* and 4*b*, an arc-shaped side 5, and the like. Note that, when the swing control weight 1 is used, the side 4*a*, which forms a right-angle corner portion 6 of the main body 2, is disposed so as to face forward of a swing direction of a user, and the other side 4*b* is disposed so as to face the user.

Figure 3:
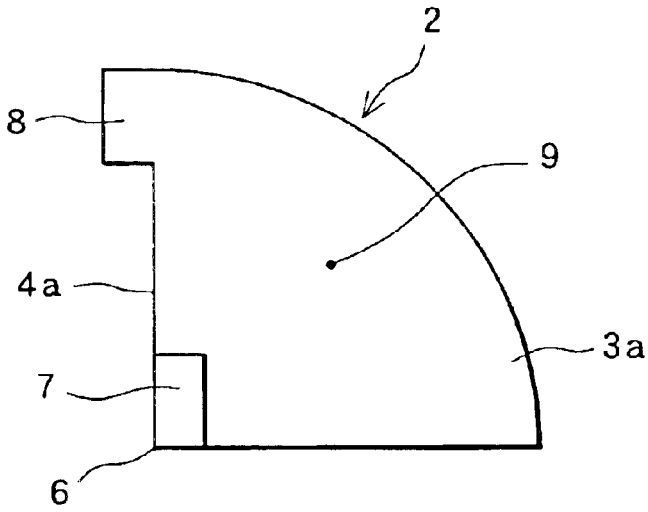
FIG. 3 is a plan view of the swing control weight.

In the main body 2, a projection 7, which projects in a direction vertical to the front main surface 3*a*, is formed in the vicinity of the right-angle corner portion 6 of the front main surface 3*a*, and further a projection 8, which projects in a direction vertical to the side 4*a*, is disposed in the vicinity of the extreme end of the side 4*a*. At the time, as shown in FIG. 3, both the main surface projection 7 and the side projection 8 are formed in, for example, a cuboid shape. The length of the respective projections 7 and 8 are set to one half the radius of the main body 2, and the projecting length thereof is set equal or less than the thickness of the main body 2. Note that the swing control weight 1 is arranged such that the position of the center of gravity 9 of the main body 2 is not included in the region in which the projection 7 of the main body 2 is disposed.

As shown in FIGS. 1–3, 5 and 6 the projections 7, 8 are substantially perpendicular to each other.

Further, a columnar attachment pin 10 is disposed on the rear main surface 3*b* so as to project in a direction vertical to the rear main surface 3*b* from the position of the center of gravity 9 of the main body 2 At the time, an escape preventing portion 11, which has a diameter larger than that of the attachment pin 10, is formed to the attachment pin 10 at, for example, a part on the extreme end side thereof nearer to a center so that the main body 2 can be firmly fixed by the attachment pin 10.

Figure 4:
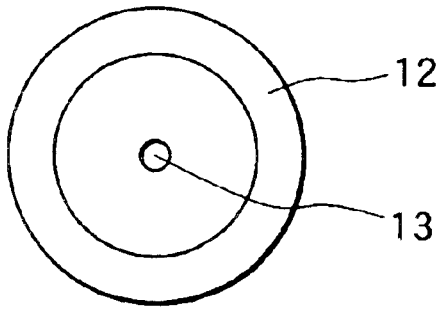
FIG. 4 is a front elevational view of the rear end surface of the grip of the golf club.

Since any of ordinary golf clubs has a center hole 13 formed at the center of the rear end surface 12 of the grip 14 thereof so that a marker for indicating the position of a ball is attached therein, the swing control weight 1 is attached to the golf club making use of the center hole 13 as shown in FIG. 4.

Figure 5:
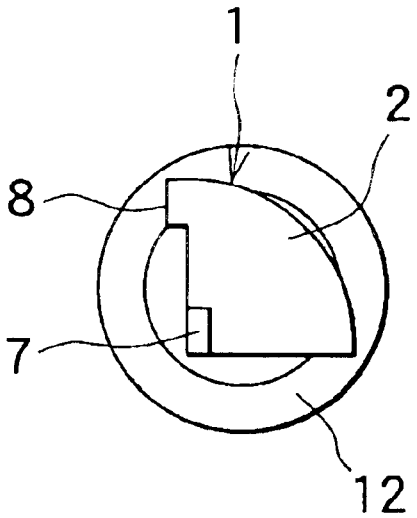
FIG. 5 is a front elevational view of the rear end surface of the grip of the golf club to which the swing control weight is attached.

Thus, inserting the attachment pin 10 of the weight 1 into the center hole 13 causes a rubber constituting the grip 14 to act to prevent the weight 1 from escaping from the center-hole 13, thereby the main body 2 can be attached and fixed to the rear end surface 12 of the grip 14 so that it covers a predetermined position of the rear end surface 12 as shown in FIG. 5. Note that since the rear end surface 12 of the grip 14 is slightly curved, the main body 2 is formed in a curved shape so that it can be in intimate contact with the curved surface of the rear end surface 12.

Moreover, as shown in FIG. 1, the weight 1 is attached to the grip 14 in such a manner that the right-angle corner portion 6, which is composed of the two orthogonal sides 4*a* and 4*b* of the main body 2, is disposed to face the user (player) standing in front of the golf club 15 and further to face forward of the swing direction of the user that is a direction perpendicular to the face 17 of a head 16 of the golf club 15 (left direction of an X-axis in FIG. 1). Further, the side 4*b* of the main body 2 is disposed in parallel with the swing direction (X-axis direction) of the user, thereby the main body 2 of the weight can be accurately positioned. Accordingly, the other side 4*a*, which is naturally orthogonal to the side 4*b*, is in parallel with a direction (Y-axis direction) perpendicular to the swing direction, thereby the arc-shaped side 5 is farthest from the user when it is located forward of the swing direction and gradually approaches the user as it moves rearward of the swing direction. Note that when the weight 1 is attached to the grip 14, the angle at which the side 4*b* is disposed may be appropriately adjusted according to the preference of the user, for example, the side 4*b* may be slightly inclined with respect to the swing direction in place of that it is disposed in parallel with the swing direction.

When the user uses the golf club 15 after the weight 1 is attached thereto, the user comes to the ready grasping the grip 14, and makes a swing to hit a ball with the face 17. At the time, the user can feel the distributed state of weights of the swing control weight 1 based on the shape of the weight while imaging the shape so that the user can be conscious of the relation between the swing direction and the positions of the two orthogonal sides 4*a* and 4*b* of the weight main body 2. Accordingly, since the swing state of the user can be automatically corrected by the main body 2, the golf club 15 is unlikely to move irregularly, thereby the face 17 of the head 16 can be moved smoothly and easily hit the ball at right angles, thereby a patting accuracy can be improved. As a result, the straight-traveling-stability of the ball is enhanced because the ball is unlikely to break right and left.

Figure 6:
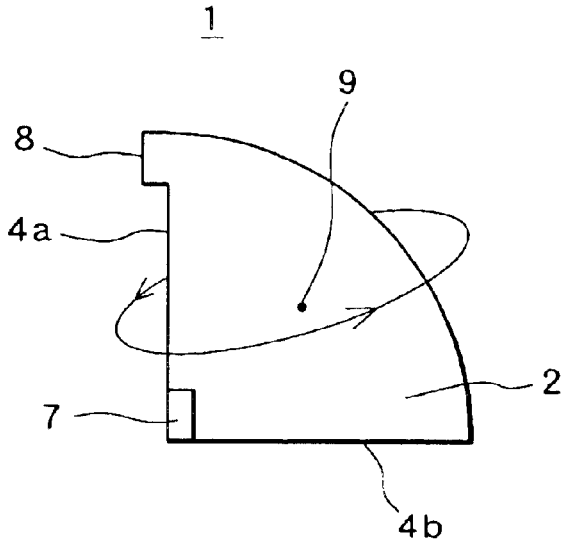
FIG. 6 is a plan view showing the swing control weight which is turned with a side, which is perpendicular to a swing direction, kept obliquely when the weight is swung.

Further, since the weight of the rear end surface 12 of the grip 14 is increased by the weight 1 attached thereto and both the extreme ends of the two orthogonal sides 4*a* and 4*b* of the weight main body 2 are connected to each other through the arc-shaped side 5, the golf club 15 is unlikely to move irregularly at a final swing position. Accordingly, it is possible to speedily and completely swing the golf club 15 and to turn the head 16, thereby the carry of the ball can be increased. Further, when the weight 1 is provided with the projections 7 and 8 in the vicinity of the right-angle corner portion 6 of the front main surface 3*a* of the main body 2 and in the vicinity of the extreme end of the side 4*a* facing forward of a swing direction, respectively, the weight 1 can be easily rotated in the direction of an arrow that inclines with respect to the side 4*a* vertical to the swing direction of the main body 2 depending on the positions, shapes, weights, and the like of the respective projections 7 and 8 as shown in FIG. 6. Since wrists can be twisted well and easily turned, the ball can easily get on the face 17 of the head 16 and can be softly impacted with the face 17. Moreover, since the ball can be hit by a small swing with a small amount of back swing, it is easy to aim at the ball. As a result, the straight-traveling stability of the ball can be more enhanced and the carry of the ball can be increased because fatigue is reduced and power is increased.

When the weight 1 is used by being attached to the rear end surface 12 of the golf club 15, it is preferable to use the weight 1 in an ion club, wood club and driver with which the user is required to draw a large circle using his or her entire body in a swing. In such a case, the flying direction of a ball is stabilized by the enhanced straight-traveling stability of the ball and the carry of the ball can be increased 10 yards or more. Note that it is preferable to manufacture swing control weights in various weights so that the user can appropriately select them acceding to preference.

Figure 7:
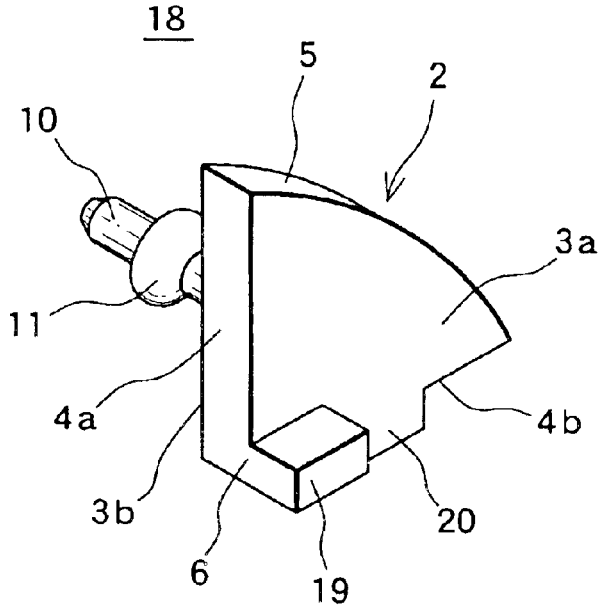
FIG. 7 is a perspective view of another swing control weight to which the present invention is applied.
Figure 8:
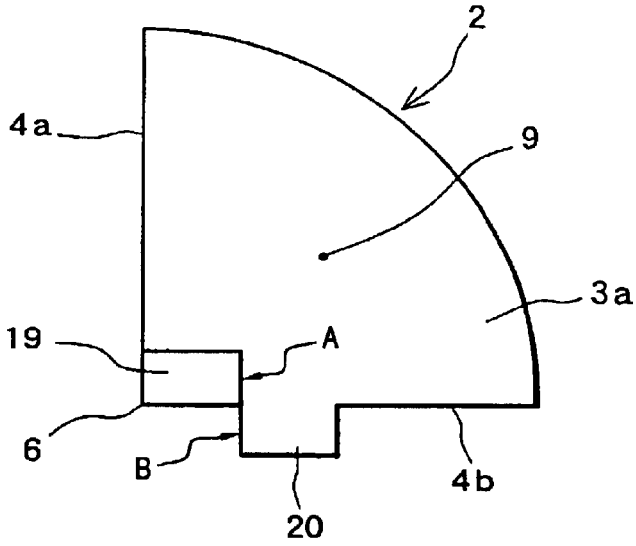
FIG. 8 is a plan view of the another swing control weight.

FIG. 7 is a perspective view showing another swing control weight for golf to which the present invention is applied, and FIG. 8 is a plan view showing the swing control weight. The swing control weight 18 is composed of a main body 2, an attachment pin 10 projecting from the position of center of gravity 9 of the main body 2, and an escape preventing portion 11 disposed to the attachment pin 10, these portions are formed in the same shapes, structures, and the like as those of the swing control weight 1, and the portions of the swing control weight 18 corresponding to those of the swing control weight 1 are denoted by the same reference numerals. However, the swing control weight 18 has projections 19 and 20 disposed on a front main surface 3*a* of the main body 2 and on a side 4*b* thereof facing a user, respectively different from the swing control weight 1 which has the projections 7 and 8 disposed in the vicinity of the right-angle corner portion 6 of the front main surface 3*a* of the main body 2 and in the vicinity of the extreme end of the side 4*a* facing forward of the swing direction, respectively.

At the time, the main surface projection 19 is disposed in the vicinity (A) of the right-angle corner portion 6 of the front main surface 3*a* so as to project vertically from the front main surface 3*a*, and the side projection 20 is disposed so as to project vertically from the side 4*b*. Moreover, as shown in FIG. 8, the position of the main surface projection 19 at the rear end of swing thereof is located at approximately the same position (B) as that the position of the side surface projection 20 at the front end of swing thereof (at the same position in the figure), and the respective projections 19 and 20 are formed in, for example, a cuboid shape. Then, the length of the portions, which are in parallel with both the edges of the main body 2 and forms the right-angle corner portions 6 of the respective projections 19 and 20, is set one-half or less the radius of the main body 2, and the projecting length of the respective projections 19 and 20 is set equal or less the thickness of the main body 2. Note that the weight 18 is arranged such that the position of the center of gravity 9 of the main body 2 is not included in the region in which the projection 19 of the main body 2 is disposed. As shown in FIGS. 7–10, the projections 19, 20 are substantially perpendicular to each other.

Figure 9:
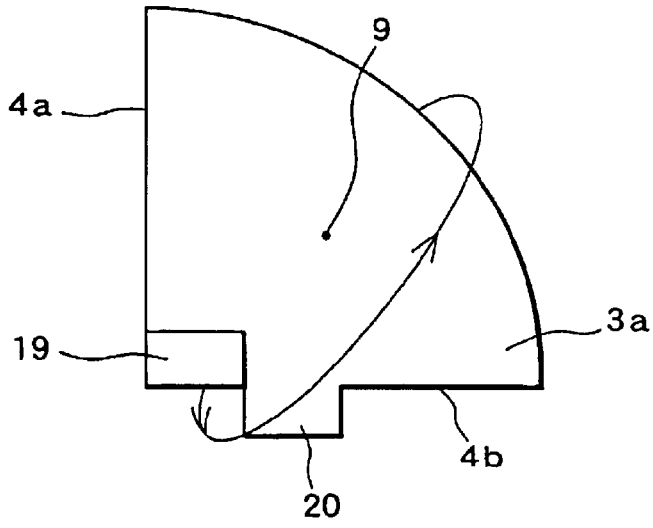
FIG. 9 is a plan view showing the another swing control weight which is turned with a side, which is parallel with a swing direction, kept obliquely when the weight is swung.
Figure 10:
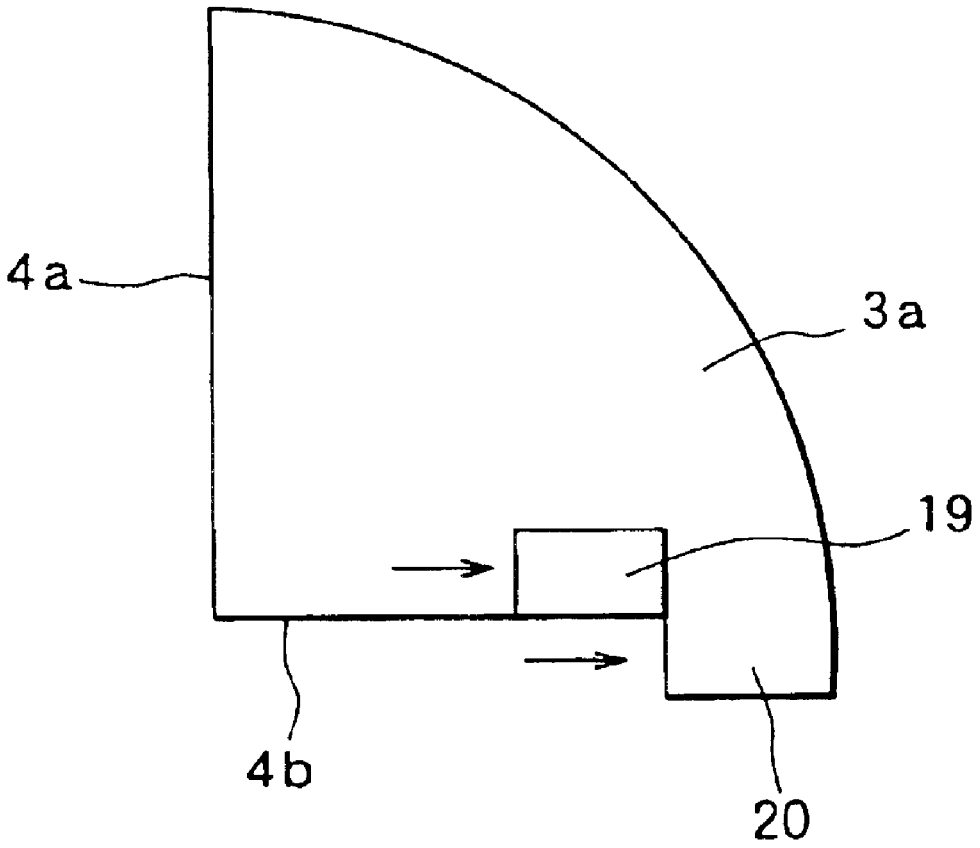
FIG. 10 is a plan view showing a state in which respective projections of the another swing control weight are moved in the extreme end direction of the side parallel with the swing direction and disposed in the vicinity of the extreme end of the side.

When the weight 18 is attached to the rear end surface of a golf club likewise and used, the weight 18 can be easily rotated in the direction of an arrow that inclines with respect to the side 4*b* parallel with the swing direction of the main body 2 as shown in FIG. 9 depending on the positions, shapes, weights, and the like of the respective projections 19 and 20 because the weight 18 is provided with the projections 19 and 20 in the vicinity of the side 4*b* facing the user of the front main surface 3*a* of the main body 2 and on the side 4*b* thereof facing the user, respectively, and the position of the main surface projection 19 at the rear end of swing thereof is located at approximately the same position as that of the position of the side surface projection 20 at the front end of swing thereof.

Thus, since wrists can be twisted well and easily turned, the ball can easily get on the face of a head and can be softly impacted with the face. Moreover, since the ball can be hit by a small swing with a small amount of back swing, it is easy to aim at the ball. As a result, the swing can be made easily, the straight-traveling stability of the ball can be more enhanced, and the carry of the ball can be increased because fatigue is reduced and power is increased. In particular, the swing control weight 18 can be suitably applied to a putter with which it is required to draw a small circle only by wrists. In this case, since the flying direction of a ball is stabilized by the straight-traveling stability thereof, a cup-in rate can be increased 10% or more. It should be noted that not only the weight can be manufactured in various sizes and weights but also the positions of the respective projections 19 and 20 can be moved in the direction of an arrow up to the extreme end position of the side 4*b* shown in FIG. 10 along the side 4*b* facing the user, the user can select a weight suitable for him or her.

Although the above embodiments have been described as to the case in which the attachment pin 10 is disposed to the rear main surface 3*b* of the main body 2, an adhesive layer may be formed using a single-faced adhesive tape, or using a double-faced adhesive tape on the rear main surface 3*b* of the main body 2 as an attachment means for more strongly fixing the main body 2.

Further, although the above embodiments have been explained as the case in which the swing control weights 1 and 18 are used by being attached to the rear end surface 12 of the grip of the golf club 15, they may be used by being attached to an arbitrary position of a golf club, baseball bat, racket of tennis and badminton, and the like.

Note that although the above embodiment shows the projection 7 and 8 disposed on the orthogonal sides 4*a* and 4*b*, the projection 20 shown in the another embodiment may be disposed on the side 4*b*, in addition to the projections 7 and B. Further, although the another embodiment shows the projection 19 and 20 disposed on the orthogonal sides 4*a* and 4*b*, the projection 8 shown in the embodiment may be disposed on the side 4*a*, in addition to the projections 19 and 20.

According to the present invention explained above, since the user can feel the distributed state of weights of the swing control weight based on the shape of the weight while imaging the shape in the first aspect of the invention, the user can be conscious of the relation between the swing direction and the positions of the two orthogonal sides of the weight main body. Thus, since the swing of the golf club can be automatically corrected by the main body, the golf club is unlikely to be irregularly swung so that the head can easily hit the ball on the face at right angles, thereby a patting accuracy can be improved. Accordingly, the straight-traveling-stability of the ball is enhanced because the ball and the like are unlikely to break right and left. Further, since both the extreme ends of the two orthogonal sides of the weight main body are connected to each other through an arc-shaped side, the golf club is unlikely to move irregularly at a final swing position, thereby it is possible to smoothly, speedily and completely swing the golf club, thereby the carry of the ball and the like can be increased.

Further, when the projections are disposed in the vicinity of the right-angle corner portion of the front main surface of the weight main body and in the vicinity of the extreme end of the side thereof facing forward of the swing direction, respectively, the weight can be easily rotated obliquely with respect to the side vertical to the swing direction depending on the positions, shapes, weights, and the like of the respective projections in a swing. Thus, since wrists can be twisted well and easily turned, the ball and the like can easily get on the face of the head and can be softly impacted with the face. Moreover, since the ball can be hit by a small swing with a small amount of back swing, it is easy to aim at the ball. As a result, the swing can be made easily, the straight-traveling stability of the ball can be more enhanced, and the carry of the ball can be increased because fatigue is reduced and power is increased.

In a second aspect of the invention, since the projections are disposed in the vicinity of the side facing the user of the front main surface of the weight main body and to the side thereof facing the user, the weight can be easily rotated obliquely with respect to the side parallel to the swing direction depending on the positions, shapes, weights, and the like of the respective projections in a swing. Thus, since wrists can be twisted well and easily turned, the ball and the like can easily get on the face of the head and can be softly impacted with the face. Moreover, since the ball can be hit by a small swing with a small amount of back swing, it is easy to aim at the ball. As a result, the swing can be made easily as well as the straight-traveling stability of the ball can be more enhanced, the carry of the ball can be increased, and the cap-in rate can be increased because fatigue is reduced and power is increased.

In a third aspect of the present invention, the weight can be simply attached by the attachment means projecting from the position of the center of gravity of the rear main surface of the weight main body, thereby a swing direction can be easily aligned with the two orthogonal sides of the main body so that the main body can be accurately positioned.

Further, in a fourth aspect of the present invention, the weight can be simply attached by the adhesive layer formed on the rear main surface of the main body thereof, and when the weight is provided with the attachment means projecting from the rear main surface, the weight can be more strongly fixed by the adhesive layer.

What is claimed is:

1. A swing control weight configured for attachment to a swinging device, comprising:

a main body comprising a quarter-disc-shaped member and having a right-angle corner portion formed of a side facing forward of a swing direction of a user and another side facing the user;

at least a pair of projections disposed in the vicinity of the right-angle corner portion of a front main surface of the main body and in the vicinity of an extreme end of the side facing forward of the swing direction, respectively; and wherein the projections are substantially perpendicular to one other.

2. The control weight as claimed in claim 1, further comprising attachment means disposed to a rear main surface of the main body and projecting from the position of the center of gravity of the main body in a direction perpendicular to the rear main surface.

3. The swing control weight as claimed in claim 2, further comprising an adhesive layer disposed on the rear main surface of the main body.

4. The swing control weight as claimed in claim 1, further comprising an adhesive layer disposed on the rear main surface of the main body.

5. A swing control weight configured for attachment to a swinging device, comprising:

a main body comprising a quarter-disc-shaped member and having a right-angle corner portion formed of a side facing forward of a swing direction of a user and another side facing the user;

at least a pair of projections disposed in the vicinity of the right-angle corner portion of a front main surface of the main body and to the side facing the user, respectively, the projections are substantially perpendicular to one other; and wherein the position of the main surface projection at the rear end of swing thereof is located at approximately the same position as that of the position of the side surface projection at the front end of swing thereof.

6. The swing control weight as claimed in claim 5, further comprising attachment means disposed to a rear main surface of the main body and projecting from the position of the center of gravity of the main body in a direction perpendicular to the rear main surface.

7. The swing control weight as claimed in claim 5, further comprising an adhesive layer disposed on the rear main surface of the main body.

* * * * *